US009956665B2

(12) United States Patent
Fuhlendorf et al.

(10) Patent No.: US 9,956,665 B2
(45) Date of Patent: May 1, 2018

(54) FORM DRESSING ROLLER

(71) Applicant: SAINT-GOBAIN DIAMANTWERKZEUGE GMBH, Norderstedt (DE)

(72) Inventors: Joerg Fuhlendorf, Ellerau (DE); Detlef Lessow, Norderstedt (DE); Bert Rohde, Hamburg (DE)

(73) Assignee: SAINT-GOBAIN DIAMANTWERKZEUGE GMBH, Norderstedt (DE)

( * ) Notice: Subject to any disclaimer, the term of this patent is extended or adjusted under 35 U.S.C. 154(b) by 0 days. days.

(21) Appl. No.: 14/902,337

(22) PCT Filed: Aug. 18, 2014

(86) PCT No.: PCT/EP2014/067545
§ 371 (c)(1),
(2) Date: Dec. 30, 2015

(87) PCT Pub. No.: WO2015/024892
PCT Pub. Date: Feb. 26, 2015

(65) Prior Publication Data

US 2016/0151881 A1 Jun. 2, 2016

(30) Foreign Application Priority Data

Aug. 18, 2014 (DE) ..... 10 2013 108 918

(51) Int. Cl.
*B24B 53/14* (2006.01)
*B24B 53/06* (2006.01)
(Continued)

(52) U.S. Cl.
CPC ..... *B24B 53/14* (2013.01); *B24B 53/062* (2013.01); *B24D 5/16* (2013.01); *B24D 18/0009* (2013.01); *B24D 18/0045* (2013.01)

(58) Field of Classification Search
CPC ..... B24B 53/14; B24B 53/062; B24D 5/16; B24D 18/0009; B24D 18/0045
(Continued)

(56) References Cited

U.S. PATENT DOCUMENTS 1,422,200 A * 7/1922 Harris ..... B24D 5/12 451/541
3,154,064 A 10/1964 Koebel
(Continued)

FOREIGN PATENT DOCUMENTS

CN 1238717 C 1/2006
CN 201645323 U 11/2010
(Continued)

OTHER PUBLICATIONS

Search Report for Chinese patent application No. 201480046216.X filed Aug. 18, 2014 on behalf of Saint-Gobain Diamantwerkzeuge GMBH. Examination Date: Sep. 7, 2016. 3 pages—English Translation Only.
(Continued)

*Primary Examiner* — Robert Rose
(74) *Attorney, Agent, or Firm* — Steinfl + Bruno LLP

(57) ABSTRACT

A form dressing roller with a carrier body and a freestanding cover ring containing diamond grains and/or diamond rods configured in ceramic, metallic, or resin bond. The form dressing roller is made and used for dressing diamond and CBN grinding wheels as well as conventional wheels with abrasives made of corundum or silicon carbide. The form dressing roller includes clamping screws for securing the cover ring between the carrier body and an attachment ring, and includes a receiving hole in the center of the carrier body. The cover ring has at least three recesses.

18 Claims, 8 Drawing Sheets

Figure 1:
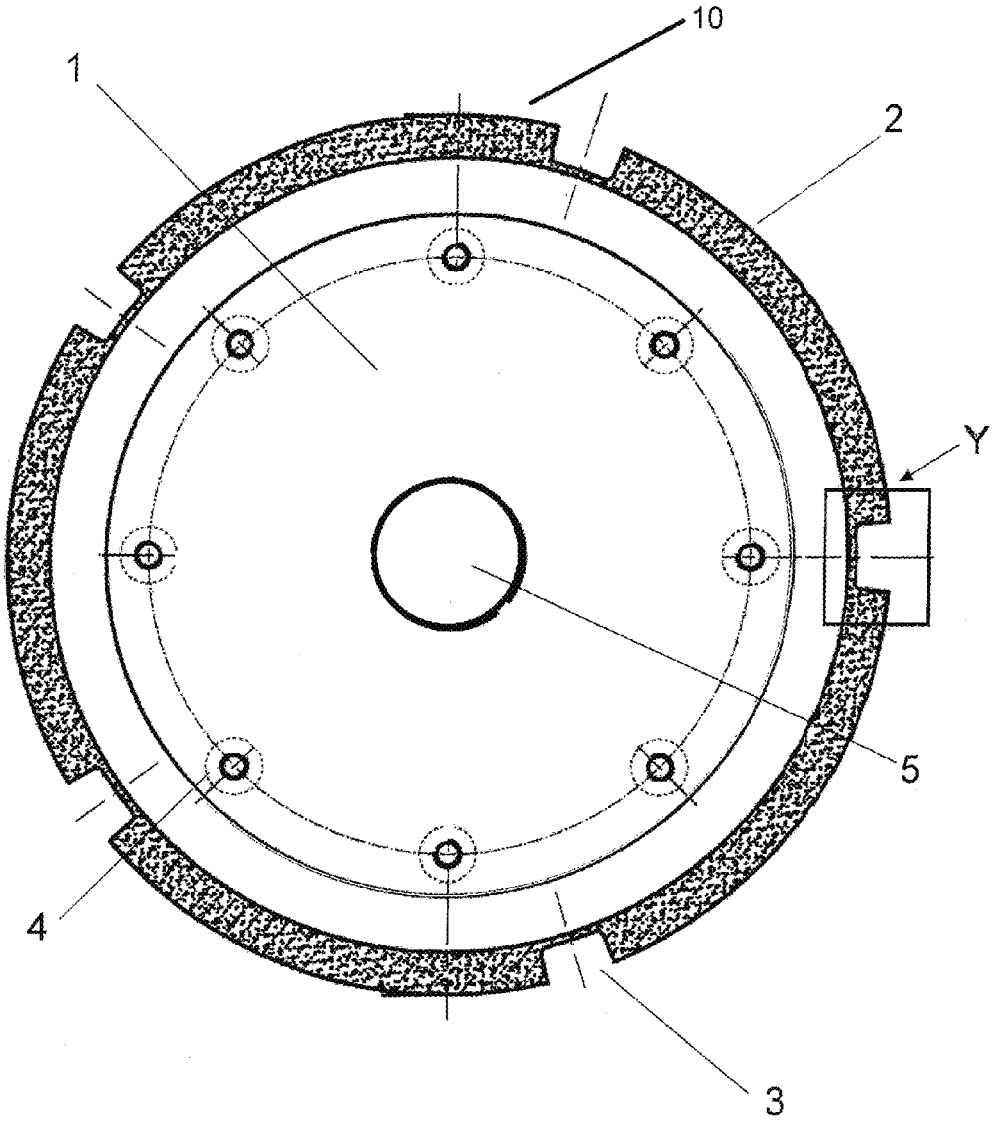

(51) Int. Cl.
*B24D 5/16* (2006.01)
*B24D 18/00* (2006.01)

(58) Field of Classification Search
USPC ..... 451/541, 542, 56, 443; 125/11.03, 15
See application file for complete search history.

(56) References Cited

U.S. PATENT DOCUMENTS

| | | | | | |
|---|---|---|---|---|---|
| 3,886,925 | A * | 6/1975 | Regan | B23D 61/10 125/15 |
| 4,915,089 | A * | 4/1990 | Ruark | B24B 53/14 125/11.03 |
| 5,871,005 | A * | 2/1999 | Sueta | B28D 1/121 125/15 |
| 6,461,940 | B1 * | 10/2002 | Hasegawa | B26D 1/0006 125/13.01 |

FOREIGN PATENT DOCUMENTS

| | | | |
|---|---|---|---|
| DE | 10 2010 000 921 | A1 | 7/2010 |
| DE | 102010000921 | A1 | 7/2010 |
| DE | 10 2010 045 836 | A1 | 3/2012 |
| EP | 0 116 668 | B1 | 8/1984 |
| EP | 1 837 123 | A1 | 9/2007 |
| EP | 1312 446 | B1 | 11/2008 |
| JP | S63169268 | A | 7/1988 |
| JP | H04244377 | A | 9/1992 |
| JP | 2006062015 | A | 3/2006 |
| JP | 2008155347 | A | 7/2008 |
| JP | 2010221311 | A | 10/2010 |
| JP | 2010269381 | A | 12/2010 |
| JP | 2013078814 | A | 5/2013 |
| WO | 91/02626 | A1 | 3/1991 |

OTHER PUBLICATIONS

Written Opinion for PCT/EP2014/067545 filed Aug. 18, 2014 on behalf of Saint-Gobain Diamantwerkzeuge GMBH & Co. & KG. 10 pages dated Oct. 2, 2014. (English Translation & German Original).
International Search Report for PCT/EP2014/067545 filed Aug. 18, 2014 on behalf of Saint-Gobain Diamantwerkzeuge GMBH & Co. & KG. dated Oct. 2, 2014 (English translation & German original).
Supplementary Search Report for Chinese Patent Application No. 201480046216.X filed Aug. 18, 2014 on behalf of Saint-Gobain Diamantwerkzeuge GMBH. dated May 16, 2017. 2 pages. English Translation Only.

* cited by examiner

FORM DRESSING ROLLER

CROSS REFERENCE TO RELATED APPLICATIONS

The present application is the US national stage of International Patent Application PCT/EP2014/067545 filed internationally on Aug. 18, 2014, which claims priority to German Patent Application No. DE 10 2013 108 918.6 filed on Aug. 19, 2013.

The present invention relates to a novel path-controlled form dressing roller and a method for its production as well as its use for dressing diamond and CBN grinding wheels in ceramic, Bakelite, metallic, or resin bond as well as conventional grinding wheels with abrasives made of corundum or silicon carbide.

For the grinding of profiles into tool surfaces, grinding wheels that have geometrically defined profiles on their grinding surface are used. These profiles must initially be incorporated by dressing into the new wheel and then reworked from time to time due to the grinding wheel wear occurring during grinding. Grinding wheel wear can result in both inadmissible profile deviations and unsatisfactory grinding behavior, with the grinding forces, the temperature of the tool surface, and/or the surface roughness falling out of tolerance.

Diamond form dressing rollers that bear a layer of diamonds on their circumferential surface have proven their worth for the path-controlled dressing of conventional grinding wheels with abrasives made of corundum or silicon carbide. This diamond layer can consist of a diamond grit in a bond of galvanically deposited nickel or also of polycrystalline diamond aggregates that are held on the circumferential surface of the form dressing roller by a galvanically or chemically deposited nickel precipitate or by a sinter metal applied in a sinter process.

In some cases, very small concave radii must be incorporated into the circumferential grinding wheel surface in order to achieve very small corner radii on the workpiece, for example, 0.1 mm or 0.2 mm. For this, form dressing rollers are ground in their largest diameter such that a convex radius with a corresponding diameter is created. The wear on the form dressing roller occurring through the dressing of the fine edges is naturally high. When the wear exceeds the profile tolerance, the form dressing roller must be re-ground or even replaced.

EP 0 116 668 B1 disclosed a form dressing roller that solves the problem of wear on a diamond form dressing roller by a multilayer diamond coating perpendicular to the axis of rotation of the dressing roller and a single layer diamond coating in the direction of the axis of rotation. The diamond coating forms a profile perpendicular to the axis of rotation that generates itself under constant dressing conditions and thus permits a greater amount of wear without the profile falling out of tolerance. Fine profiles can be achieved with the known form dressing roller through the selection of a finer grit.

The dressing is composed of the profiling and sharpening of the grinding wheel. The profiling is required to return the profile of the grinding wheel to the desired shape and tolerance. The sharpening takes place in order to moreover restore the grinding capability of the grinding wheel, i.e., to bring the grinding forces, the generation of heat, and the surface roughness created on the workpiece back within the required limits.

From EP 1312 446 B1, a form dressing roller with a coating of diamond grains for dressing diamond grinding wheels is known. The form dressing roller has a closed cover ring. It has been demonstrated that the known form dressing roller cannot durably satisfy the increasing requirements for profile accuracy and for actual surface roughness on the dressed grinding wheel.

Good profile accuracy of the grinding wheel is critical to the outcome of the dressing operation. Before dressing, a dressing contour is predefined by a program. The role of dressing is to strictly adhere to the predefined profile in a predefined timeframe.

High actual surface roughness of the grinding wheel after dressing is critical to the outcome of the grinding operation. The actual surface roughness on the grinding wheel increased by dressing results in improved grinding action of the grinding wheel.

The object of the present invention consists in providing a path-controlled form dressing roller that produces better profile accuracy and a greater actual surface roughness on the grinding wheel, wherein the wear of the form dressing roller is so slight that even long profile strokes can be dressed with great profile accuracy on a diamond grinding wheel.

A further object of the present invention consists in providing an economical and environmentally friendly method for producing the path-controlled form dressing roller.

The object is accomplished through the characteristics of claims 1, 12, and 16. Preferred embodiments are apparent from the subclaims.

The object according to the invention is preferably accomplished by a form dressing roller with a carrier body, a freestanding cover ring with diamond grains in ceramic, metallic, or resin bond for dressing diamond and CBN grinding wheels in ceramic, Bakelite, metallic, or resin bond as well as conventional grinding wheels with abrasives made of corundum or silicon carbide, with clamping screws that secure the cover ring between the carrier body and an attachment ring and a receiving hole in the center of the carrier body, wherein the cover ring has at least 3 recesses and the cover width of the cover ring is preferably the diamond grain size and/or the rod width.

The rotating form dressing roller according to the invention for path-controlled dressing with a freestanding and discontinuous resin cover made of natural diamond, natural needle diamond, as well as synthetic diamonds in CVD form offers a long service life and results in a high-performance grinding wheel with high actual surface roughness. In CVD (chemical vapour deposition), a few-micron-thick diamond layer is deposited in a vacuum chamber on the substrates, for example, carbide tools. The starting material is typically a gas mixture of methane and hydrogen, with the former serving as a carbon source. The form dressing roller is suitable for dressing all bonded grinding wheels and grinding elements as well as for all diamond or CBN grinding wheels and CBN grinding discs. Similarly to diamond, cubic boron nitride (CBN) can be produced from the hexagonal modification of boron nitride using high pressure-high temperature synthesis. CBN does not completely reach the hardness of diamond, but is, for example, resistant to oxygen at high temperatures.

The form dressing roller according to the invention with large diamond grain sizes in a freestanding diamond cover with discontinuous cut offers a long service life and results in a high-performance grinding wheel with high actual surface roughness. Due to the freestanding diamond cover, it is possible to dress a large variety of complex profiles in one dressing cycle. Due to the discontinuous cut, high actual surface roughness and profile accuracy is produced on the grinding wheel. The form dressing roller according to the invention produces improved and more uniform workpiece quality and, thus, increased process reliability.

Path-controlled form dressing rollers with large carbide sizes and a closed cover produce high coverage ratios due to the cover widths, which results in low actual surface roughness and, thus, in a more closed grinding wheel topography.

The recesses effect a pressure reduction between the form dressing roller and the grinding wheel. The high pressure causes shape defects and profile distortion on the grinding wheel. The recesses facilitate the penetration of the individual diamond grain of the cover of the form dressing roller into the grinding wheel.

A preferred embodiment of the invention is a form dressing roller with a cover ring that has 3 to 12 recesses. By means of the dressing, high actual surface roughness is achieved on the grinding wheel. The high actual surface roughness results in improved grinding action of the grinding wheel.

A particularly preferred embodiment of the invention is a form dressing roller with a cover ring that has 4 to 6 and most preferably 5 recesses. With the number of said recesses on the cover ring of the form dressing roller, an increased actual surface roughness is achieved on the grinding wheel.

A preferred embodiment of the invention is a form dressing roller, wherein the cover ring has a cover height of 10 mm to 20 mm and a usable cover height of 4 mm to 6 mm. Improved profile accuracy is achieved on the grinding wheel by the indicated cover height of the cover ring.

A preferred embodiment of the invention is a form dressing roller, wherein the cover ring has a cover width of 0.4 mm to 2.0 mm and the cover width is the diamond grain size and/or the diamond rod size. Better profile accuracy as well as roundness of the workpiece is achieved by the indicated cover width of the cover ring.

A preferred embodiment of the invention is a form dressing roller, wherein the width of the recesses is 1 mm to 10 mm. The recesses in the form dressing roller effect better penetration of the form dressing roller diamonds into the grinding wheel bond during the dressing operation and, thus, a reduction of dressing forces. With the indicated width of the recesses of the form dressing roller, a good outcome is achieved in the reduction of dressing forces and in the increase of actual surface roughness.

A preferred embodiment of the invention is a form dressing roller, wherein the depth of the recesses corresponds to the usable depth of the cover. With the indicated depth of the recesses of the form dressing roller, a good outcome is achieved in the reduction of dressing forces and in the increase of the actual surface roughness on the grinding wheel.

A preferred embodiment of the invention is a form dressing roller, wherein the diameter of the form dressing roller is 80 mm to 250 mm. With the indicated diameters, form dressing rollers are very effective in increasing the profile accuracy as well as the service life of the form dressing roller.

A preferred embodiment of the invention is a form dressing roller, wherein the diameter of the receiving hole is 8 mm to 120 mm. This range for the receiving hole has proved very effective for better running accuracy has well as easier assembly of the form dressing roller.

A preferred embodiment of the invention is a form dressing roller, wherein the cover ring consists of at least one layer, wherein, in each layer, closely sized individual diamond grains or diamond rods are arranged in a plane perpendicular to the axis of rotation of the form dressing roller according to a predefined setting pattern. In the case of multilayer form dressing rollers, the diamond grains of one layer lie in the gaps between the diamond grains of the other layer and project partially into the other layer such that the circumferential surface geometry of the form dressing roller remains virtually constant as wear progresses. This embodiment of the invention, in particular the cover ring, has proved very effective.

Another accomplishment of the object of the invention is a method for producing the form dressing roller according to the invention, wherein

- diamond grains are set according to a predefined setting pattern on a base with an adhesive layer for producing a layer,
- bonding powder is added,
- the layer is cold pressed and sintered to form the cover, and
- the recesses are cut out of the cover.

With the form dressing roller produced according to the method according to the invention, the cover width is the diamond grain size and/or the diamond rod width. The cover ring with diamond grains produced is ground.

Another accomplishment of the object of the invention is a method for producing the form dressing roller according to the invention, wherein

- diamond grains are set according to a predefined setting pattern on a base with an adhesive layer for producing a layer, wherein the recesses in the cover are formed,
- bonding powder is added, and
- the layer is cold pressed and sintered to form the cover.

With the form dressing roller produced according to the method according to the invention, the cover width is ≤the diamond grain size and/or the diamond rod width. The cover ring with diamond grains produced is ground.

A preferred embodiment of the invention is a method for producing the form dressing roller according to the invention, wherein desired layers are stacked with relative displacement and/or rotation of the layers and the layer package is cold pressed and sintered to form the cover.

A preferred embodiment of the invention is a method for producing the form dressing roller according to the invention, wherein the form dressing roller produced is subsequently ground and finished.

The method according to the invention for producing the form dressing roller can be summarized as follows:

- a two-part base body is rough turned,
- a diamond cover ring is produced,
- a diamond cover ring is mounted in the base body,
- the complete diamond dressing system (DDS) form dressing roller is finished, balanced, polished, and cut to profile accuracy and running accuracy.

With the form dressing roller according to the invention, there is a freestanding diamond cover ring whose cover width is the diamond grain size and/or the diamond rod width used, with the grain size selected such that natural radii develop on the edges of the cover ring, which radii generate themselves and correspond to the smallest predefined concave radius on the grinding wheel.

As a bond for a form dressing roller according to the invention, a galvanic or sintered bond with high tungsten content is preferably used. The grain size is 1.5 mm, and the usable height of the diamond cover ring in the feed direction is preferably between 5 mm and 10 mm.

Another accomplishment of the object of the invention consists in that the form dressing roller for dressing diamond and CBN grinding wheels is used in ceramic, Bakelite, metallic, or resin bond as well as conventional grinding wheels with abrasives made of corundum or silicon carbide.

Figure 2:
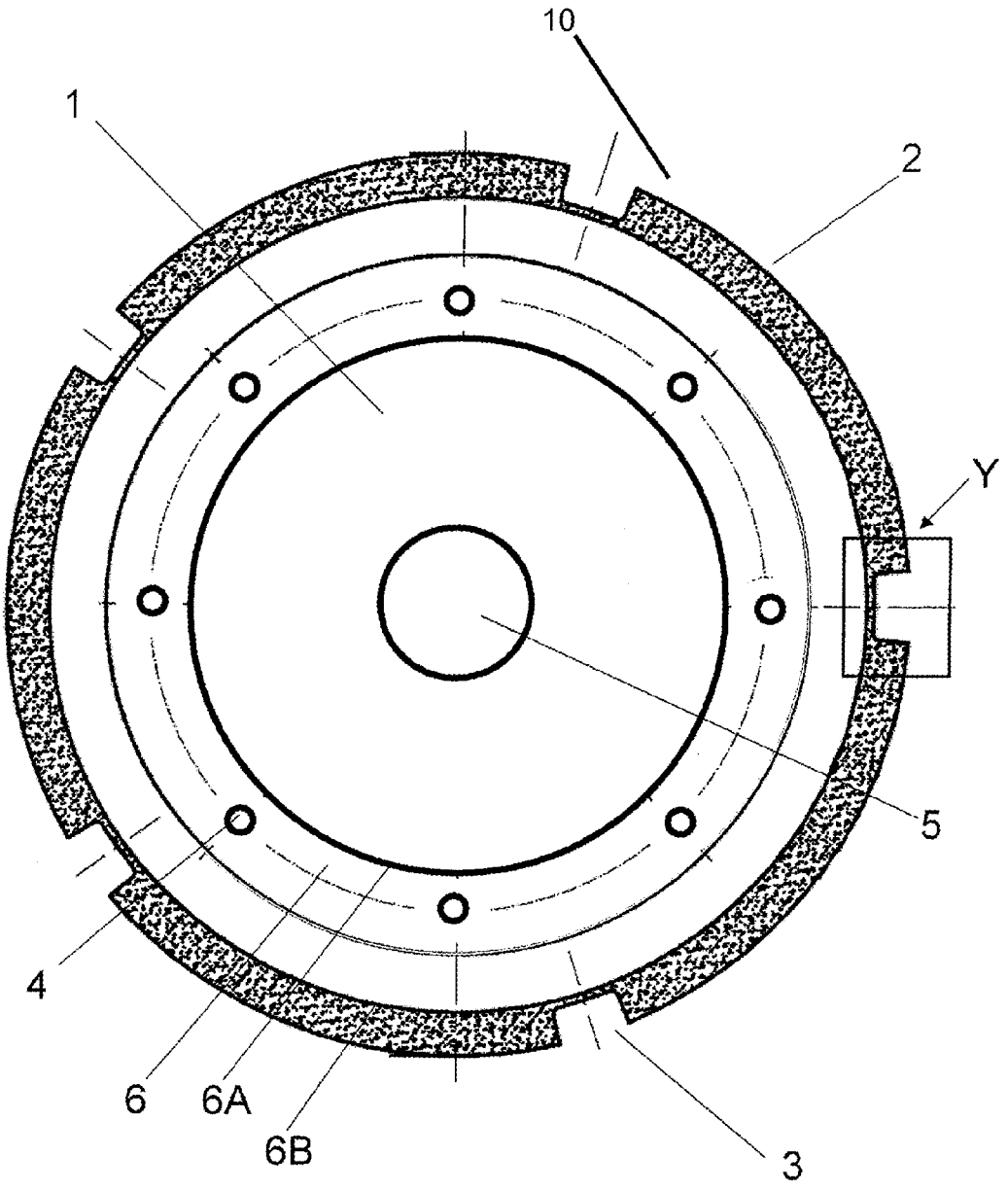
Figure 3:
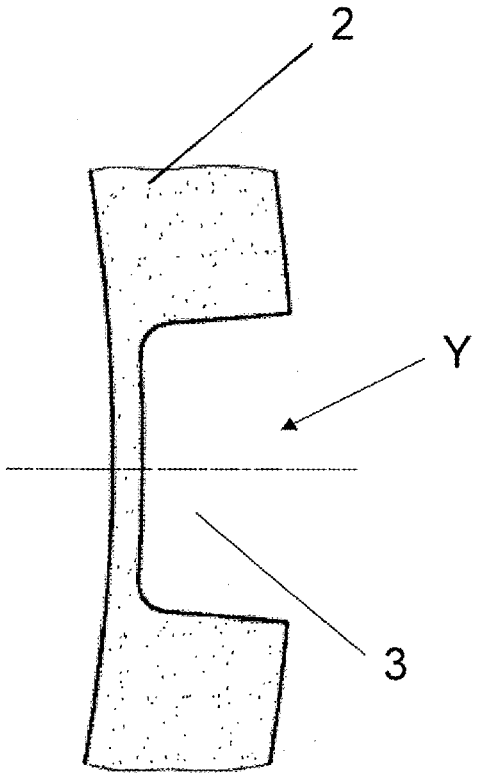
Figure 4:
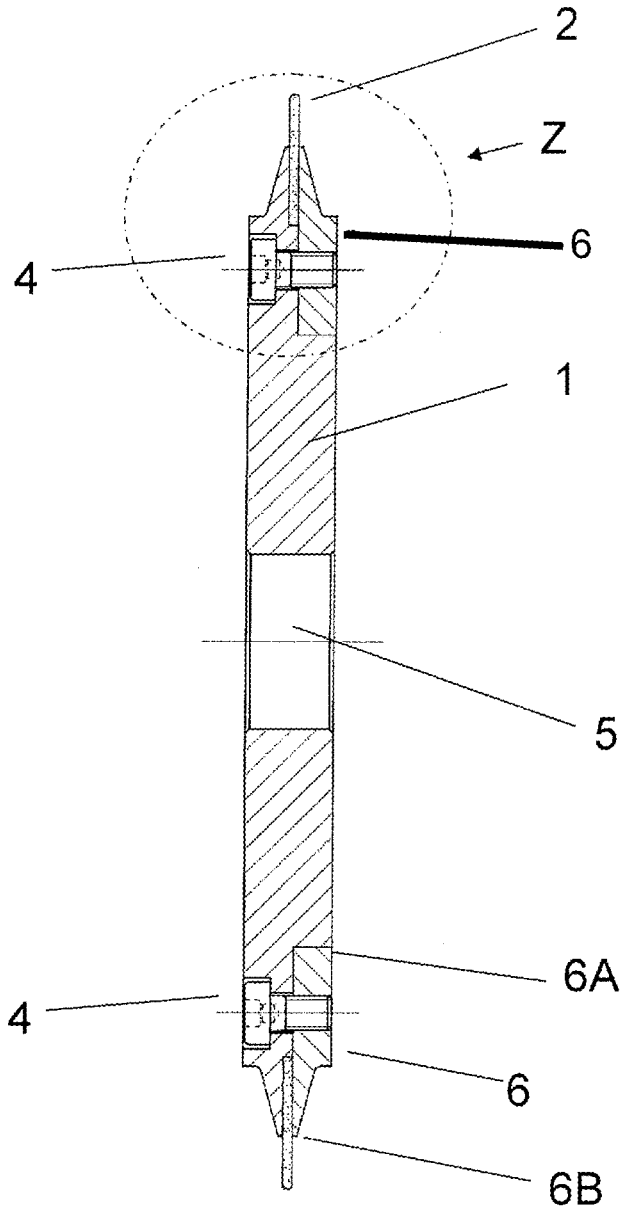
Figure 5:
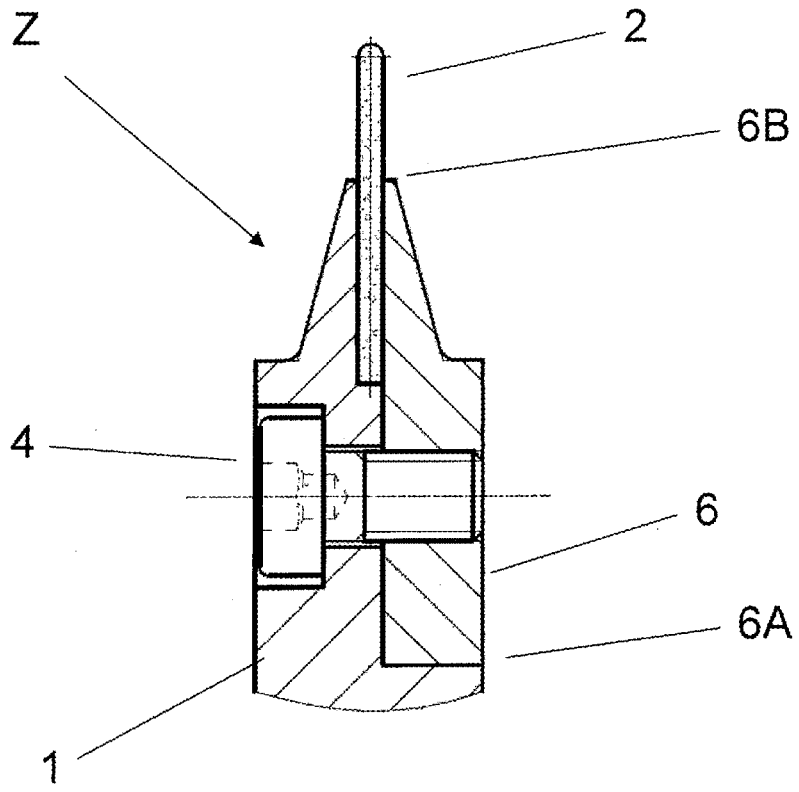
Figure 6:
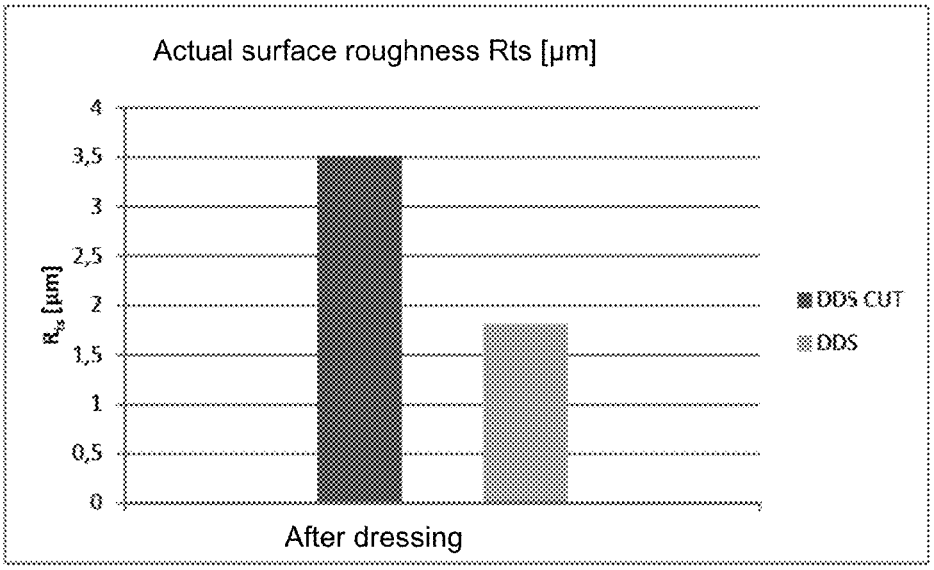
Figure 7:
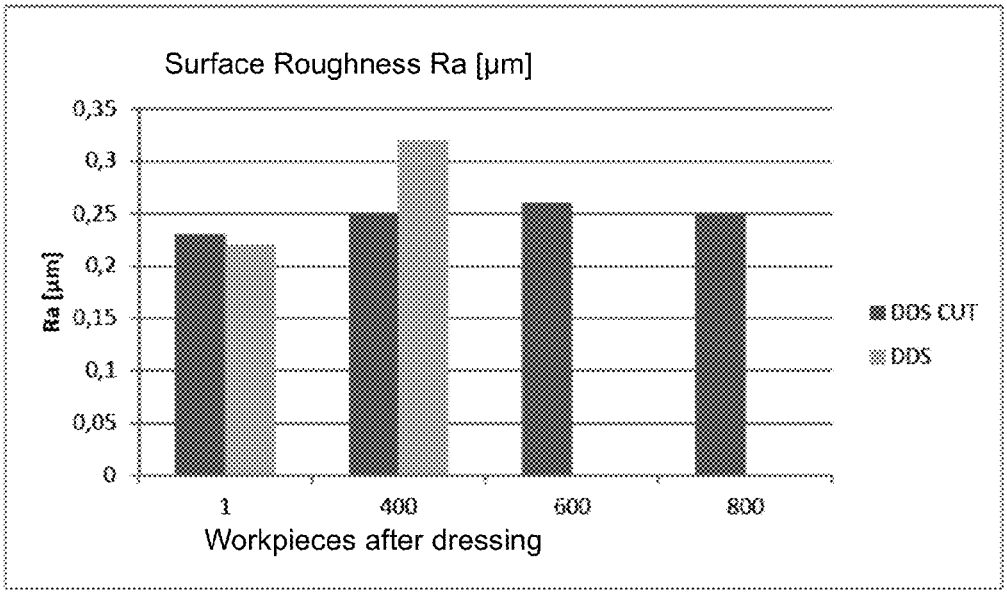
Figure 8:
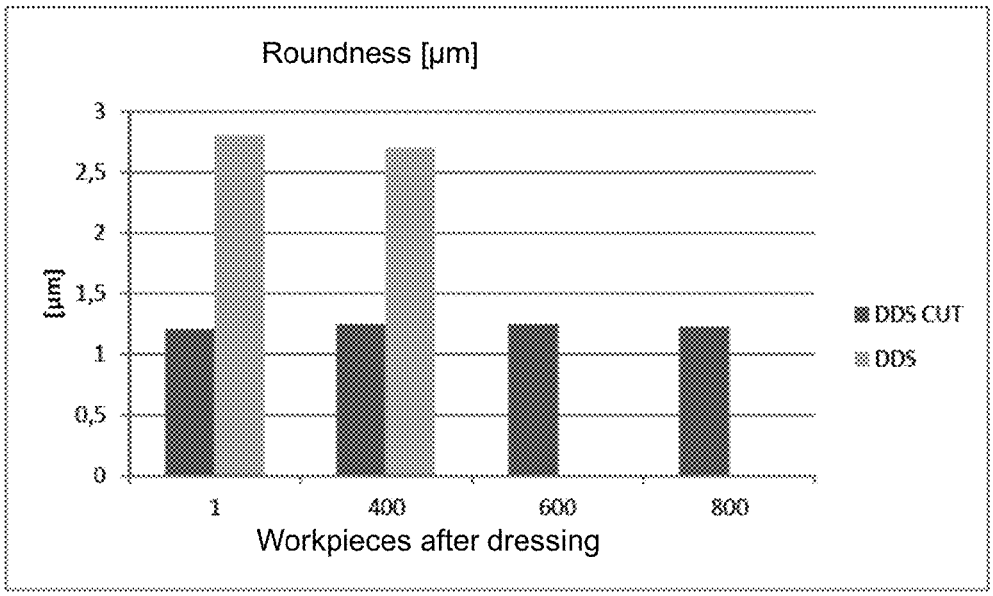

The invention is explained in detail in the following with reference to drawings. They depict:

FIG. 1 a plan view of the front side of the form dressing roller;

FIG. 2 a plan view of the back side of the form dressing roller;

FIG. 3 an enlarged detail Y of the cover with one recess according to FIG. 1 and FIG. 2;

FIG. 4 a cross-section through the form dressing roller;

FIG. 5 an enlarged detail Z of the cross-section according to FIG. 4;

FIG. 6 a graphic representation of the actual surface roughness of workpieces after dressing, with the use of a prior art form dressing roller DDS without recesses in comparison with a form dressing roller DDS cut with recesses according to the invention;

FIG. 7 a graphic representation of the surface roughness of workpieces after dressing, with the use of a prior art form dressing roller DDS without recesses in comparison with a form dressing roller DDS cut with recesses according to the invention;

FIG. 8 a graphic representation of the roundness of workpieces after dressing, with the use of a prior art form dressing roller DDS without recesses in comparison with a form dressing roller DDS cut with recesses according to the invention;

FIG. 1 depicts a plan view of the front side of a form dressing roller 10 for dressing diamond and CBN grinding wheels (not shown) in ceramic, Bakelite or resin, and/or metallic bond as well as conventional grinding wheels with abrasives made of corundum or silicon carbide. The form dressing roller 10 is an example of a diamond dressing system (DDS). The form dressing roller 10 enables high precision dressing of ceramically bonded diamond and boron nitride grinding wheels. The form dressing roller 10 includes a set one layer diamond sinter cover 2, which is clamped into a two-part steel base consisting of a carrier body 1 and a clamping ring 6. The cover 2 is made of individual diamond grains that have virtually the same size. The diamond grains lie in rays that pass through a common center of the form dressing roller 10. The diamonds are bonded into a matrix that is made of a suitable bonding material, for example, a galvanic or sinter bond with high tungsten content. The cover ring 2 in FIG. 1 has five recesses 3. FIG. 1 depicts the receiving hole 5 and the clamping screws 4.

FIG. 2 depicts a plan view of the back side of the form dressing roller 10. The inner edge 6A and outer edge 6B of the clamping ring 6 are visible.

FIG. 3 depicts an enlarged detail Y of the cover 2 with one recess 3 according to FIG. 1 and FIG. 2. The recess 3 has a width of 5 mm and a depth of 5 mm with a cover height of 5 mm. The recess 3 can be cut out or incorporated during the shaping operation.

FIG. 4 depicts a cross-section through the form dressing roller 10 and FIG. 5 depicts an enlarged detail Z of the cross-section according to FIG. 4 in the region of the clamping ring 6 and of the cover ring 2. It is readily discernible that the carrier body 1 and the clamping ring 6 are held together by the clamping screws 4. Both the carrier body 1 and the clamping ring 6 are customarily made of stainless steel. The clamping ring 6 is inserted with precise fit of the inner edge 6A into the carrier body 1. The cover ring 2 is set on the carrier body 1. The cover ring 2 is clamped between the carrier body 1 and the clamping ring 6. The outer edge 6B of the clamping ring 6 is flush with the outer edge 6B of the carrier body 1. The usable height of the cover ring 2 is 5 mm.

EXAMPLES

FIG. 6 is a graphic representation of the actual surface roughness of a ceramic CBN (cubic crystalline boron nitride) grinding wheel after dressing. In the grinding process, the restoration of concentricity, of the geometric shape as well as the optimalen actual surface roughness of the grinding wheel plays an important role. The actual surface roughness $R_{ts}$ [μm] of a dressed grinding wheel is shown. For this, a grinding wheel was dressed with a form dressing roller (DDS CUT) according to the invention and a second grinding wheel was dressed with a prior art form dressing roller (DDS). It was demonstrated that with the form dressing roller according to the invention, an actual surface roughness depth of 3.5 μm was achieved on the grinding wheel. With the prior art form dressing roller, a actual surface roughness of only 1.8 μm was achieved on the dressed grinding wheel. The actual surface roughness of the grinding wheel dressed with the form dressing roller according to the invention is greater than with the standard dressing roller. This implies higher performance grinding wheel topography. This result was surprising and unexpected.

FIG. 7 is a graphic representation of the surface roughness of a grinding wheel after dressing. In the grinding process, the restoration of the desired surface roughness of the workpiece plays an important role. The surface roughness Ra [μm] of ground workpieces is shown. For this, grinding wheels were dressed with a form dressing roller (DDS CUT) according to the invention and with a prior art form dressing roller (DDS). It was demonstrated: By means of dressing with the form dressing roller according to the invention DDS CUT, a somewhat higher surface roughness of 0.23 μm was obtained in the workpieces than with the prior art form dressing roller DDS of 0.22 μm.

With the form dressing roller according to the invention DDS CUT, in 400 workpieces, a somewhat lower surface roughness of 0.25 μm was obtained than with the prior art form dressing roller DDS of 0.32 μm. The surface roughness was, to be sure, somewhat higher with the prior art form dressing roller DDS; however, with the prior art form dressing roller, only 400 workpieces could be ground with the predefined surface roughness. Consequently, only one dressing cycle of 400 workpieces could be obtained with the prior art form roller DDS.

With the form dressing roller according to the invention DDS CUT, a surface roughness of 0.26 μm was obtained in 600 workpieces and 0.25 μm in 800 workpieces. The surface roughness was virtually constant over the 800 workpieces. The performance was doubled with the form dressing roller according to the invention (DDS CUT). A substantially better constant in the surface roughness of the ground workpieces was obtained. This result was surprising and unexpected.

FIG. 8 is a graphic representation of the roundness of the workpieces after dressing of the grinding wheel. In grinding, roundness is a measure of the accuracy with which an ideal round shape (circular shape) is obtained. There is a better roundness profile; consequently, few shape deviations occur. In the grinding process, the optimum roundness of the workpiece plays an important role. The roundness in [μm] of the workpieces is depicted. For this, grinding wheels were dressed with a form dressing roller (DDS CUT) according to the invention and with a prior art form dressing roller (DDS). It was demonstrated:

With the form dressing roller according to the invention DDS CUT, a lower roundness of 1.2 μm was obtained in the ground workpieces than with the prior art form dressing roller DDS of 2.8 μm.

With the form dressing roller according to the invention DDS CUT, a lower roundness of 1.3 μm was obtained than with the prior art form dressing roller DDS of 2.7 μm. The roundness error was higher with the prior art form dressing roller. With the prior art form dressing roller DDS, only 400 workpieces could be ground with the required accuracy. With the form dressing roller according to the invention DDS CUT, in 600 workpieces, a roundness of 1.3 μm was obtained and in 800 workpieces, a roundness of 1.2 μm was obtained. The roundness was virtually constant over the 800 ground workpieces. The performance as doubled with the form dressing roller according to the invention (DDS CUT). A substantially better constant in the roundness of the ground workpieces was obtained. The roundness results demonstrate that with the form dressing roller according to the invention (DDS CUT), constant roundness values can be achieved over the entire dressing cycle. The grinding wheels dressed with the prior art form dressing roller DDS had to already be dressed again after 400 workpieces since the surface roughness as well as the roundness fell outside the workpiece tolerance. This result was surprising and unexpected.

LIST OF REFERENCE CHARACTERS

10 form dressing roller
1 carrier body
2 cover ring/cover/diamond sinter cover
3 recesses
4 clamping screws
5 receiving hole
6 clamping ring
6A inner edge of the clamping ring
6B outer edge of the clamping ring
Y enlargement according to FIG. 1 and FIG. 2/enlarged detail Y
Z enlargement according to FIG. 4/enlarged detail Z

The invention claimed is:

1. A form dressing roller for dressing grinding wheels, comprising:
- a carrier body;
- a cover ring containing at least one of diamond grains and diamond rods configured in ceramic, metallic, or resin bond according to a predefined setting pattern;
- clamping screws that secure the cover ring between the carrier body and a clamping ring; and
- a receiving hole in the center of the carrier body, wherein the cover ring has at least three recesses.

2. The form dressing roller according to claim 1, wherein the cover ring has three to twelve recesses.

3. The form dressing roller according to claim 1, wherein the cover ring has four to six recesses.

4. The form dressing roller according to claim 1, wherein the recesses have a width of 1 mm to 10 mm.

5. The form dressing roller according to claim 1, wherein a depth of the recesses corresponds to a usable cover height.

6. A form dressing roller according to claim 1, wherein a diameter of the form dressing roller is 80 mm to 250 mm.

7. The form dressing roller according to claim 1, wherein a diameter of the receiving hole is 8 mm to 120 mm.

8. A form dressing roller for dressing grinding wheels, comprising:
- a carrier body;
- a cover ring containing at least one of diamond grains and diamond rods configured in ceramic, metallic, or resin bond;
- clamping screws that secure the cover ring between the carrier body and a clamping ring; and
- a receiving hole in the center of the carrier body, wherein the cover ring has at least three recesses,
- wherein the cover ring includes at least one layer; and
- wherein, in each layer, closely-sized individual diamond grains are arranged in a plane perpendicular to an axis of rotation of the form dressing roller according to a predefined setting pattern.

9. The form dressing roller according to claim 8,
- wherein the cover ring includes a first layer and a second layer; and
- wherein the diamond grains of the first layer lie in gaps between the diamond grains of the second layer and partially extend into the second layer such that a circumferential surface geometry of the dressing roller remains virtually constant as wear progresses.

10. A method for producing a cover for a form dressing roller, comprising:
- producing at least one diamond layer, including setting diamond grains according to a predefined setting pattern on a base with an adhesive layer;
- adding bonding powder to the at least one diamond layer;
- cold pressing and sintering the at least one diamond layer onto the base to form a cover, wherein a cover width is equal to or less than a diamond grain size; and
- cutting recesses out of the cover.

11. The method according to claim 10, prior to cold pressing and sintering the at least one diamond layer onto the base to form a cover,
- stacking at least two diamond layers with at least one of relative displacement and rotation of the at least two diamond layers to from a layer package; and
- cold pressing and sintering the layer package onto the base to form the cover.

12. The method according to claim 10, further including grinding and finishing the at least one diamond layer.

13. A method for producing a cover for a form dressing roller, comprising:
- producing a at least one diamond layer, including setting diamond grains according to a predefined setting pattern on a base with an adhesive layer;
- forming recesses in the base;
- adding bonding powder to the at least one diamond layer; and
- cold pressing and sintering the at least one diamond layer onto the base to form a cover.

14. The method according to claim 13, prior to cold pressing and sintering the at least one diamond layer diamond layer onto the base to form a cover,
- stacking at least two diamond layers with at least one of relative displacement and rotation of the at least two diamond layers to form a layer package; and
- cold pressing and sintering the layer package onto the base to form the cover.

15. The method according to claim 13, further including grinding and finishing the at least one diamond layer.

16. A method of using a form dressing roller, comprising:
- producing a form dressing roller, including
  - a carrier body, a cover ring containing at least one of diamond grains and diamond rods configured in ceramic, metallic, or resin bond, clamping screws that secure the cover ring between the carrier body and a clamping ring, and a receiving hole in the center of the carrier body, wherein the cover ring has at least three recesses; and dressing a grinding wheel with the form dressing roller.

17. A method of using a form dressing roller according to claim 16, wherein dressing a grinding wheel with the form dressing roller includes dressing a diamond or CBN grinding wheel configured in ceramic, Bakelite, metallic, or resin bond.

18. A method of using a form dressing roller according to claim 16, wherein dressing a grinding wheel with the form dressing roller includes dressing a grinding wheel with abrasives made of corundum or silicon carbide.

* * * * *